US012130061B2

(12) United States Patent
Sakthivel et al.

(10) Patent No.: US 12,130,061 B2
(45) Date of Patent: Oct. 29, 2024

(54) HOT GAS DEFROST USING MEDIUM TEMPERATURE COMPRESSOR DISCHARGE

(71) Applicant: Heatcraft Refrigeration Products LLC, Stone Mountain, GA (US)

(72) Inventors: Saravana Vaithilingam Sakthivel, Chennai (IN); Karthick Kuppusamy, Salem (IN)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 73 days.

(21) Appl. No.: 17/466,065

(22) Filed: Sep. 3, 2021

(65) Prior Publication Data

US 2023/0071132 A1 Mar. 9, 2023

(51) Int. Cl.

| | |
|---|---|
| ***F25B 47/02*** | (2006.01) |
| ***F25B 5/02*** | (2006.01) |
| ***F25B 41/22*** | (2021.01) |
| ***F25B 41/24*** | (2021.01) |

(52) U.S. Cl.

CPC ..... *F25B 47/022* (2013.01); *F25B 5/02* (2013.01); *F25B 41/22* (2021.01); *F25B 41/24* (2021.01); *F25B 2400/23* (2013.01)

(58) Field of Classification Search

CPC ..... F25B 47/022; F25B 5/02; F25B 41/22; F25B 41/24; F25B 2400/23

See application file for complete search history.

(56) References Cited

U.S. PATENT DOCUMENTS

| | | | | |
|---|---|---|---|---|
| 2,978,877 | A * | 4/1961 | Long | F25B 5/02 62/278 |
| 4,012,921 | A | 3/1977 | Willitts et al. | |
| 5,321,956 | A * | 6/1994 | Kemp | F25B 43/02 62/84 |
| 9,377,236 | B2 | 6/2016 | Hinde et al. | |
| 2005/0039473 | A1 | 2/2005 | Pondicq-Cassou et al. | |
| 2008/0184715 | A1* | 8/2008 | Chen | F25B 47/022 62/81 |
| 2012/0011866 | A1* | 1/2012 | Scarcella | F25B 41/39 62/79 |
| 2015/0377541 | A1* | 12/2015 | Yoshikawa | F25B 49/02 62/140 |

(Continued)

FOREIGN PATENT DOCUMENTS

| | | |
|---|---|---|
| DE | 10233411 B4 | 9/2013 |
| EP | 1498673 B1 | 8/2013 |

(Continued)

OTHER PUBLICATIONS

Extended European Search Report, Application No. 22189134.4 mailed Jan. 23, 2023.

*Primary Examiner* — Elizabeth J Martin
*Assistant Examiner* — Samba Gaye

(57) ABSTRACT

A refrigeration system includes an expansion valve downstream of one or more medium temperature compressors. The expansion valve is configured to decrease pressure of a portion of refrigerant output by the one or more medium temperature compressors. When defrost operation of an evaporator is indicated, the refrigerant with decreased pressure from the expansion valve is provided to the evaporator for at least a period of time sufficient to defrost the evaporator.

16 Claims, 4 Drawing Sheets

(56) References Cited

U.S. PATENT DOCUMENTS

| | | | | |
|---|---|---|---|---|
| 2016/0054040 | A1* | 2/2016 | Jonsson | F25B 13/00 62/503 |
| 2020/0080757 | A1* | 3/2020 | Suzuki | F25B 41/22 |
| 2021/0095901 | A1* | 4/2021 | Perez-Blanco | F25B 43/043 |

FOREIGN PATENT DOCUMENTS

| | | | | |
|---|---|---|---|---|
| EP | 2496893 | B1 * | 1/2019 | F25B 1/10 |
| EP | 3872416 | A1 | 9/2021 | |
| FR | 2933482 | A3 | 1/2010 | |
| WO | 2010117973 | A2 | 10/2010 | |
| WO | 2011054397 | A1 | 5/2011 | |

* cited by examiner

HOT GAS DEFROST USING MEDIUM TEMPERATURE COMPRESSOR DISCHARGE

TECHNICAL FIELD

This disclosure relates generally to refrigeration systems and methods of their use. More particularly, in certain embodiments, this disclosure relates to hot gas defrost using medium temperature compressor discharge.

BACKGROUND

Refrigeration systems are used to regulate environmental conditions within an enclosed space. Refrigeration systems are used for a variety of applications, such as in supermarkets and warehouses, to cool stored items. For example, refrigeration systems may provide cooling operations for refrigerators and freezers.

SUMMARY OF THE DISCLOSURE

During operation of refrigeration systems, ice may build up on evaporators. These evaporators need to be defrosted to remove ice buildup and prevent loss of performance. Previous evaporator defrost processes are limited in terms of their efficiency and effectiveness. For example, using previous technology, defrost processes may take a relatively long time and consume a relatively large amount of energy. In some cases, previous technology may be incapable of providing adequate defrosting, for instance, in cases where a relatively large number of evaporators need to be defrosted in a multiple-evaporator refrigeration system.

This disclosure provides technical solutions to the problems of previous technology, including those described above. For example, a refrigeration system is described that facilitates improved evaporator defrost using a medium temperature discharge gas. The refrigeration system also uses a defrost-mode expansion valve that depressurizes high pressure, high temperature discharge gas provided from one or more medium-temperature compressors. The expanded refrigerant is provided to defrost one or more evaporators of the refrigeration system. The pressure of the heated refrigerant may be adjusted by the defrost-mode expansion valve to achieve improved defrost performance. In some cases, evaporators of the refrigeration system may be configured to support operation at increased pressures (e.g., of about 45 bar or 60 bar) to facilitate this new defrost process.

Embodiments of this disclosure may provide improved defrost operations to evaporators of refrigeration systems, such as $CO_2$ transcritical refrigeration systems. The refrigeration system of this disclosure facilitates the development of an increased pressure differential to drive the flow of refrigerant during defrost processes. The refrigeration system provides a higher mass flow rate of refrigerant than was available in previous systems in order to defrost multiple evaporators rapidly and efficiently. Higher refrigerant temperatures (e.g., of about 110° C.) can be achieved for improved evaporator defrost operations. During defrost operations, low-temperature compressors can operate under regular discharge pressures such that refrigeration processes continue efficiently for evaporators that are not being defrosted. Defrost operations can continue even in cases when low-temperature compressors are not present or during low load scenario. Certain embodiments may include none, some, or all of the above technical advantages. One or more other technical advantages may be readily apparent to one skilled in the art from the figures, descriptions, and claims included herein.

In an embodiment, a refrigeration system includes one or more medium temperature (MT) compressors, a gas cooler located downstream from the one or more MT compressors, a defrost-mode valve located downstream from the one or more MT compressors, a first evaporator unit located downstream from the gas cooler, and a controller communicatively coupled to the defrost-mode valve. The one or more MT compressors are configured to compress refrigerant. The gas cooler is configured to receive at least a portion (e.g., up to all when all evaporator units in refrigeration mode) of the compressed refrigerant and facilitate heat transfer from the received refrigerant to the ambient air, thereby cooling the refrigerant. The first evaporator unit includes an evaporator and is configured to receive a portion of the refrigerant cooled by the gas cooler when the first evaporator unit is operated in a refrigeration mode. The controller is configured to determine that operation of the first evaporator unit in a defrost mode is indicated. After determining that operation of the first evaporator unit in the defrost mode is indicated, the controller causes the first evaporator unit to operate in a defrost mode. Causing the first evaporator unit to operate in the defrost mode includes causing the defrost-mode valve to at least partially open. The defrost-mode valve is configured, when open, to divert a portion of the compressed refrigerant provided by the one or more MT compressors away from the gas cooler, expand the diverted portion of the refrigerant, and allow the expanded portion of the refrigerant to flow to the first evaporator unit, thereby defrosting an evaporator of the first evaporator unit.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1-4 of the drawings, like numerals being used for like and corresponding parts of the various drawings.

As described above, prior to this disclosure, defrost operations of refrigeration systems suffered from certain inefficiencies and drawbacks. The refrigeration system of this disclosure provides improvements in defrost performance and energy efficiency. In some cases, the refrigeration system may ensure that all appropriate defrost operations can be performed when needed, while previous technology may have been limited in the number of evaporators that could be defrosted at a given time or over a given period of time.

The refrigeration system of this disclosure may be a $CO_2$ transcritical refrigeration system. Transcritical refrigeration systems differ from conventional refrigeration systems in that transcritical systems circulate refrigerant that becomes a supercritical fluid above the critical point. As an example, the critical point for carbon dioxide ($CO_2$) is 31° C. and 73.8 MPa, and above this point, $CO_2$ becomes a homogenous mixture of vapor and liquid that is called a supercritical fluid. This unique characteristic of transcritical refrigerants is associated with certain operational differences between transcritical and conventional refrigeration systems. For example, transcritical refrigerants are typically associated with discharge temperatures that are higher than their critical temperatures and discharge pressures that are higher than their critical pressures. When a transcritical refrigerant is at or above its critical temperature and/or pressure, the refrigerant may become a "supercritical fluid"—a homogenous mixture of gas and liquid. Supercritical fluid does not undergo phase change processes in a gas cooler as occurs in a condenser of a conventional refrigeration system circulating traditional refrigerant. Rather, supercritical fluid is cooled to a lower temperature in the gas cooler. Stated differently, the gas cooler in a transcritical refrigeration system receives and cools supercritical fluid and the transcritical refrigerant undergoes a partial state change from gas to liquid as it is discharged from an expansion valve.

Refrigeration System

Figure 1:
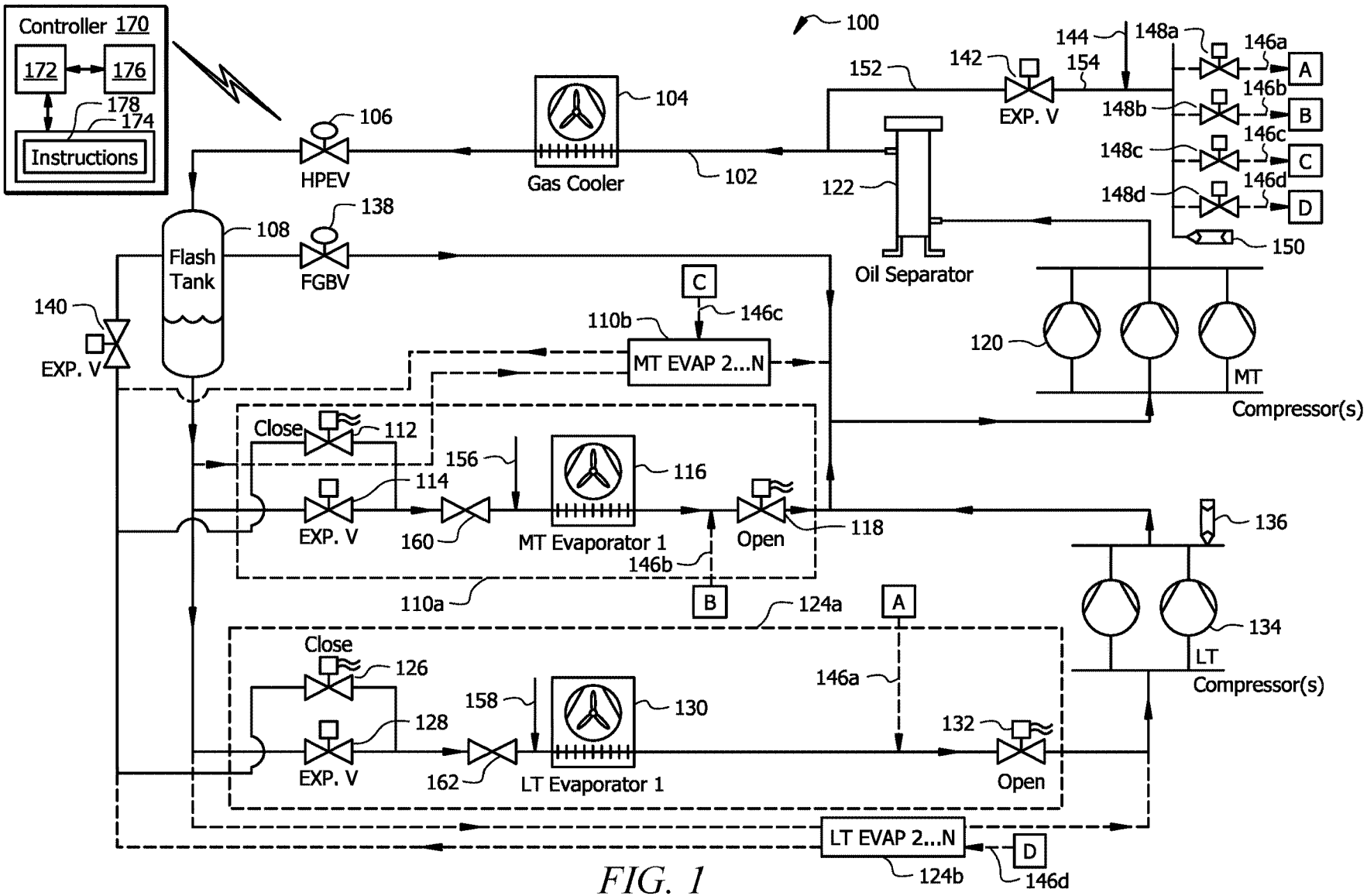
FIG. 1 is a diagram of an example refrigeration system with a defrost-mode valve when the system is configured to operate the evaporator units in a refrigeration mode.
Figure 2:
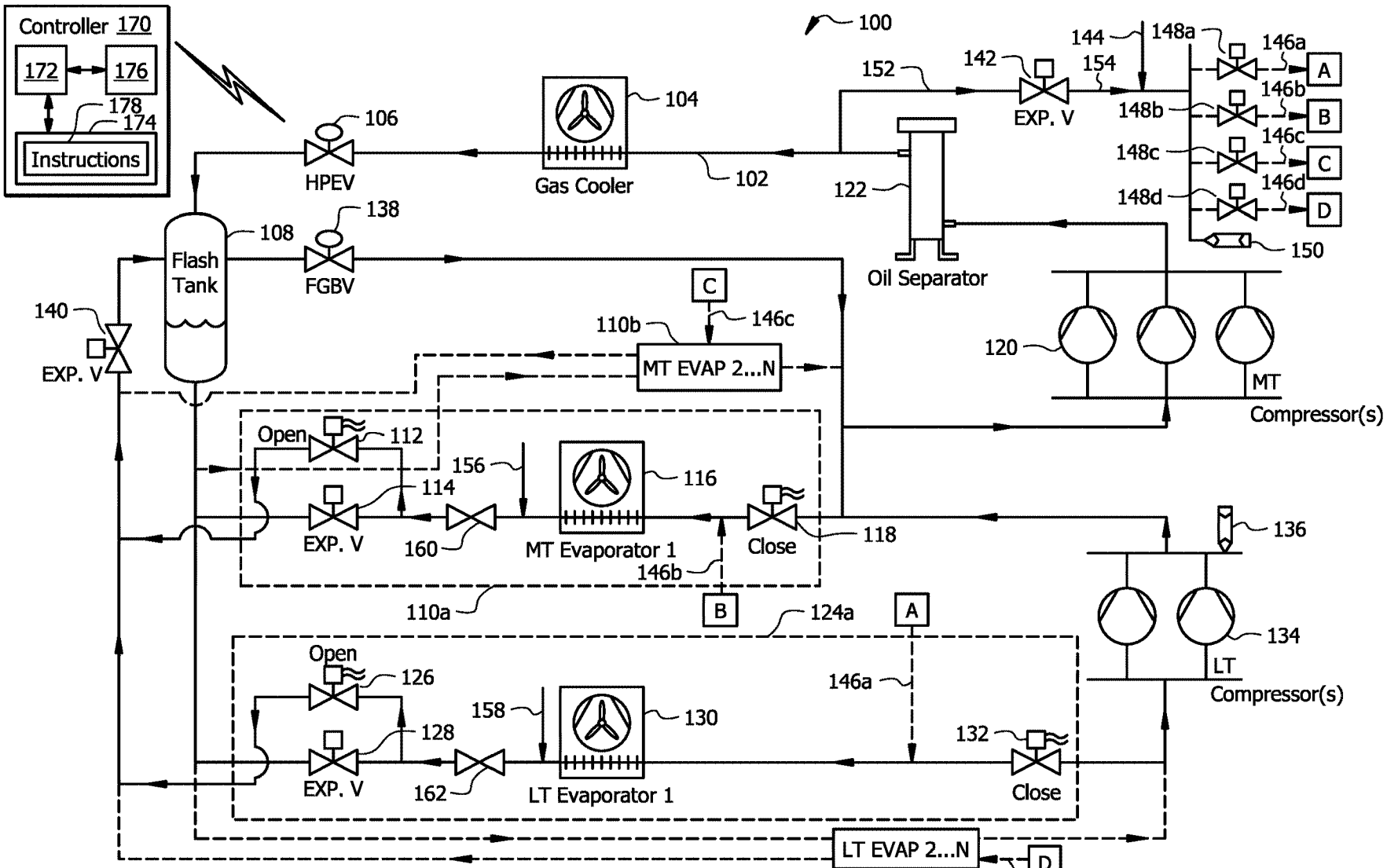
FIG. 2 is a diagram of the refrigeration system of FIG. 1 when the system is configured to operate a low temperature and medium temperature evaporator unit in defrost mode.

FIGS. 1 and 2 illustrate an example refrigeration system 100 configured for improved defrost operation. The refrigeration system 100 shown in FIG. 1 is configured to operate evaporator units 110*a,b*, 124*a,b* in the refrigeration mode, such that the evaporators 116, 130 provide cooling to a corresponding space, such as a freezer and deep freeze, respectively (not shown for clarity and conciseness). FIG. 2 illustrates the example refrigeration system 100 when configured for operation of evaporator units 110*a*, 124*a* in a defrost mode, such that evaporators 116, 130 are defrosted. When at least one of the evaporator units 110*a,b*, 124*a,b* is operated in defrost mode, a portion of high pressure high temperature refrigerant generated by one or more medium-temperature (MT) compressors is provided via a defrost-mode expansion valve 142 to defrost evaporators 116, 130 of the evaporator units 110*a,b*, 124*a,b* operated in defrost mode. The refrigerant provided from the defrost-mode expansion valve 142 removes ice buildup from coils of the evaporator(s) 116, 130.

Refrigeration system 100 includes refrigerant conduit subsystem 102, gas cooler 104, expansion valve 106, flash tank 108, one or more MT evaporator units 110*a,b*, one or more MT compressors 120, an oil separator 122, one or more low-temperature (LT) evaporator units 124*a,b*, one or more LT compressors 134, a pressure-relief valve 136, a bypass valve 138, an expansion valve 140, the defrost-mode expansion valve 142, refrigerant conduit 146*a-d*, and controller 170. In some embodiments, refrigeration system 100 is a transcritical refrigeration system that circulates a transcritical refrigerant such as $CO_2$.

Refrigerant conduit subsystem 102 facilitates the movement of refrigerant (e.g., $CO_2$) through a refrigeration cycle such that the refrigerant flows in the refrigeration mode as illustrated by the arrows in FIG. 1. The refrigerant conduit subsystem 102 includes conduit, tubing, and the like that facilitates the movement of refrigerant between components of the refrigeration system 100. For clarity and conciseness, only a single conduit of the refrigerant conduit subsystem 102 is labeled in FIGS. 1 and 2 as refrigerant conduit subsystem 102. The refrigerant conduit subsystem 102 includes any conduit, tubing, and the like that is illustrated in FIGS. 1 and 2 connecting components of the refrigeration system 100.

Gas cooler 104 is generally operable to receive refrigerant (e.g., from MT compressor(s) 120 or oil separator 122) and apply a cooling stage to the received refrigerant. In some embodiments, gas cooler 104 is a heat exchanger comprising cooler tubes configured to circulate the received refrigerant and coils through which ambient air is forced. Inside gas cooler 104, the coils may absorb heat from the refrigerant and dissipates it to the ambient air, thereby cooling the refrigerant.

Cooled refrigerant from gas cooler 104 is provided to expansion valve 106. Expansion valve 106 is configured to receive gas refrigerant from gas cooler 104 and reduce the pressure of the received refrigerant. In some embodiments, this reduction in pressure causes some of the refrigerant to vaporize. As a result, mixed-state refrigerant (e.g., refrigerant vapor and liquid refrigerant) may be discharged from expansion valve 106. In some embodiments, this mixed-state refrigerant is discharged to flash tank 108. When outdoor temperatures are low (e.g., such as in the winter), valve 106 can be controlled to maintain a sufficient pressure in the gas cooler 104 to ensure that temperatures of the refrigerant provided for defrost are high enough to defrost evaporators(s) 116, 130 being defrosted, when at least one of the evaporator units 110*a,b*, 124*a,b* is operated in the defrost mode illustrated in FIG. 2.

Flash tank 108 is configured to receive mixed-state refrigerant and separate the received refrigerant into flash gas and liquid refrigerant. Typically, the flash gas collects near the top of flash tank 108 and the liquid refrigerant is collected in the bottom of flash tank 108. In some embodiments, the liquid refrigerant flows from flash tank 108 and provides cooling to the MT evaporator units 110*a,b* and LT evaporator units 124*a,b*.

When operated in refrigeration mode (see FIG. 1), the MT evaporator units 110*a,b* receive cooled liquid refrigerant from the flash tank 108 and use the cooled refrigerant to provide cooling. Each of the MT evaporator units 110*a,b* includes an evaporator 116 along with appropriate valves 112, 114, 118 to facilitate operation of the MT evaporator units 110*a,b* in both a refrigeration mode (see FIG. 1) and a defrost mode (see FIG. 2). In some embodiments, evaporator 116 is designed to operate at an increased pressure (e.g., of at least 45 bar or 60 bar) relative to typical refrigeration system compressors. This may facilitate the use of the unique defrost process described in this disclosure. As an example, the evaporator 116 may be part of a refrigerated case and/or cooler for storing food and/or beverages that must be kept at particular temperatures. For clarity and conciseness, the components of a single MT evaporator unit 110*a* are illustrated. The refrigeration system 100 may include any appropriate number of MT evaporator units 110*a,b* with the same or a similar configuration to that shown for the example MT evaporator unit 110*a*.

When the MT evaporator unit 110*a* is operating in the refrigeration mode illustrated in FIG. 1, the first valve 112 upstream of the evaporator 116 is closed and the second valve 118 downstream of the evaporator 116 is open. In this configuration, the liquid refrigerant from flash tank 108 flows through expansion valve 114, where the pressure of the refrigerant is decreased, before it reaches the evaporator 116. Expansion valve 114 may be the same as or similar to expansion valve 106, described above. Expansion valve 114 may be configured to achieve a refrigerant temperature into the evaporator 116 at a predefined temperature (e.g., about −6° C.). The controller 170 may be in communication with valve 114 and control its operation (e.g., amount the valve 114 is open) to achieve the predefined temperature.

When the MT evaporator unit 110*a* is operating in the defrost mode illustrated in FIG. 2, the first valve 112 upstream of the evaporator 116 is open and the second valve 118 downstream of the evaporator 116 is closed. In this configuration, heated refrigerant from refrigerant conduit 146*b* flows through the evaporator 116 and defrosts the evaporator 116. Refrigerant exiting the evaporator 116 flows through the opened valve 112 and to expansion valve 140. Expansion valve 140 expands the refrigerant (i.e., decreases pressure of the refrigerant) before it flows back into the flash tank 108. Expansion valve 140 may be the same as or similar to expansion valves 106 and/or 114. A temperature and/or pressure sensor 156 may be located, or disposed, on, in, or near the evaporator 116 or refrigerant conduit connected to the evaporator 116. In some embodiments, the MT evaporator unit 110*a* includes a pressure-activated valve 160 disposed in refrigerant conduit between the first valve 112 and the evaporator 116 that only allows refrigerant to flow after a threshold pressure has been reached. For example, the threshold pressure may be at least a predefined amount (e.g., 3 bar, 10 bar, or the like) greater than an internal pressure of the flash tank 108. This may ensure that a sufficient pressure is achieved to drive the flow of refrigerant from expansion valve 140 into the flash tank 108. Information from sensor 156 may assist in determining when operation in defrost mode is appropriate or should be ended, as described further below.

Valves 112 and 118 may be in communication with controller 170, and the controller 170 may provide instructions for adjusting the valves 112, 118 to open or closed positions to achieve the configuration of FIG. 1 for refrigeration mode operation and the configuration of FIG. 2 for defrost mode operation. For example, instructions 178 implemented by the processor 172 of the controller 170 may determine that operation of the first evaporator unit 110*a* in a defrost mode is indicated. For example, instructions 178 stored by the controller 170 may indicate that defrost mode operation is needed on a certain schedule or at a certain time. As another example, a temperature of the evaporator 116 may indicate that defrost mode operation is needed (e.g., because the temperature indicates that expected cooling performance or efficiency is not being obtained). When defrost mode is indicated, the controller 170 at least partially opens defrost-mode expansion valve 142, opens first valve 112, and closes second valve 118 to obtain the defrost mode configuration illustrated in FIG. 2.

In some embodiments, the defrost-mode expansion valve 142 may be opened to achieve a predefined output pressure. For example, the refrigerant may be provided from the defrost-mode expansion valve 142 at a pressure that is at least somewhat higher than (e.g., 10% or more greater than) the pressure of refrigerant in the flash tank 108. In some embodiments, the defrost-mode expansion valve 142 outputs refrigerant at a pressure of about (e.g., within about 5% of) 841 psig. In such embodiments, the evaporator 116 is rated for pressures of at least 870 psig. In some embodiments, the defrost-mode expansion valve 142 outputs refrigerant at a pressure of about (e.g., within about 5% of) 624 psig. In such embodiments, the evaporator 116 is rated for pressures of at least 650 psig.

Once defrost mode operation is complete, the controller 170 may end defrost mode operation by closing defrost-mode expansion valve 142, closing first valve 112, and opening second valve 118 to return to the refrigeration mode configuration illustrated in FIG. 1. In some embodiments, the controller 170 may cause defrost mode to end after a predefined period of time included in the instructions 178. In some embodiments, the controller 170 may cause defrost mode operation to end after predefined conditions indicated in the instructions 178 are measured by the temperature and/or pressure sensor 156. For example, defrost mode operation may end when a temperature measured by sensor 156 increases to at least a threshold temperature (e.g., of about 11° C.). In some embodiments, defrost mode operation may end when complete condensation is achieved in the evaporator 116 (e.g., at a temperature of 20.5° C.)

Refrigerant from the MT evaporator units 110*a,b* that are operating in refrigeration mode (i.e., MT evaporator units 110*a* and 110*b* in FIG. 1 and MT evaporator unit 110*b* in FIG. 2) is provided to the one or more MT compressors 120. The MT compressor(s) 120 are configured to compress refrigerant discharged from the MT evaporator units 110*a* and/or 110*b* and provide supplemental compression to refrigerant discharged from any of the LT evaporator units 124*a,b* that are operating in refrigeration mode (LT evaporator units 124*a,b* are described further below). Refrigeration system 100 may include any suitable number of MT compressors 120. MT compressor(s) 120 may vary by design and/or by capacity. For example, some compressor designs may be more energy efficient than other compressor designs, and some MT compressors 120 may have modular capacity (e.g., a capability to vary capacity). The controller 170 is in communication with the MT compressors 120 and controls their operation.

LT evaporator units 124*a,b* are generally similar to the MT evaporator units 110*a,b* but configured to operate at lower temperatures (e.g., for deep freezing applications near about −30° C. or the like). When operated in refrigeration mode (see FIG. 1), the LT evaporator units 124*a,b* receive cooled liquid refrigerant from the flash tank 108 and use the cooled refrigerant to provide cooling. Each of the LT evaporator units 124*a,b* includes an evaporator 130 along with appropriate valves 126, 128, 132 to facilitate operation of the LT evaporator units 124*a,b* in both a refrigeration mode (see FIG. 1) and a defrost mode (see FIG. 2). In some embodiments, evaporator 130 is designed to operate at an increased pressure (e.g., of at least 45 bar or 60 bar) relative to typical refrigeration system compressors. This may facilitate the use of the unique defrost process described in this disclosure. As an example, the evaporator 130 may be part of a deep freezer for relatively long term storage of perishable that must be kept at particular temperatures. For clarity and conciseness, the components of a single LT evaporator unit 124*a* are illustrated. The refrigeration system 100 may include any appropriate number of LT evaporator units 124*a,b* with the same or a similar configuration to that shown for the LT evaporator unit 124*a*.

When the LT evaporator unit 124*a* is operating in the refrigeration mode illustrated in FIG. 1, the first valve 126 upstream of the evaporator 130 is closed and the second valve 132 downstream of the evaporator 130 is open. In this configuration, the liquid refrigerant from flash tank 108 flows through expansion valve 128, where the pressure of the refrigerant is decreased, before it reaches the evaporator 130. Expansion valve 128 may be the same as or similar to expansion valve 114, described above. Expansion valve 128 may be configured to achieve a refrigerant temperature into the evaporator 130 at a predefined temperature (e.g., about −30° C.). The controller 170 is in communication with expansion valve 128 and controls its operation (e.g., amount the valve 128 is open) to achieve the predefined temperature.

When the LT evaporator unit 124*a* is operating in the defrost mode illustrated in FIG. 2, the first valve 126 upstream of the evaporator 130 is open and the second valve 132 downstream of the evaporator 130 is closed. In this configuration, heated refrigerant from refrigerant conduit 146*a* flows through the evaporator 130 and defrosts the evaporator 130. In the defrost mode illustrated in FIG. 2, the heated refrigerant flows in a backward direction through the evaporator 130 relative to the flow of refrigerant in the refrigeration mode illustrated in FIG. 1. Refrigerant exiting the evaporator 130 flows through the opened first valve 126 and to expansion valve 140. Expansion valve 140 expands the refrigerant (i.e., decreases pressure of the refrigerant) before it flows back into the flash tank 108. Expansion valve 140 may be the same as or similar to expansion valves 106 and/or 128. In some embodiments, the LT evaporator unit 124*a* includes a pressure-activated valve 162 disposed in refrigerant conduit between the first valve 126 and the evaporator 130 that only allows refrigerant to flow after a threshold pressure has been reached. For example, the threshold pressure may be at least a predefined amount (e.g., 3 bar, 10 bar, or the like) greater than an internal pressure of the flash tank 108. This may ensure that a sufficient pressure is achieved to drive the flow of refrigerant from expansion valve 140 into the flash tank 108. A temperature and/or pressure sensor 158 may be located on, in, or near the evaporator 130 or refrigerant conduit connected to the evaporator 130. Similarly to as described with respect to sensor 156 above, information from sensor 158 may assist in determining when operation in defrost mode is appropriate or should be ended.

Valves 126 and 132 may be in communication with controller 170, and the controller 170 may provide instructions for adjusting the valves 126, 132 to open or closed positions to achieve the configuration of FIG. 1 for refrigeration mode operation and the configuration of FIG. 2 for defrost mode operation. For example, as described with respect to the MT evaporator unit 110*a* above, instructions 178 implemented by the processor 172 of the controller 170 may determine that operation of the first evaporator unit 124*a* in a defrost mode is indicated. For example, instructions 178 stored by the controller 170 may indicate that defrost mode operation is needed on a certain schedule or at a certain time. As another example, a temperature of the evaporator 130 may indicate that defrost mode operation is needed (e.g., because expected cooling performance or efficiency is not being obtained). When defrost mode operation is indicated, the controller 170 at least partially opens defrost-mode expansion valve 142, opens first valve 126, and closes second valve 132 to obtain the defrost mode configuration illustrated in FIG. 2.

In some embodiments, the defrost-mode expansion valve 142 may be opened to achieve a predefined output pressure. For example, the refrigerant may be provided from the defrost-mode expansion valve 142 at a pressure that is at least somewhat higher than (e.g., 10% or more greater than) the pressure of refrigerant in the flash tank 108. In some embodiments, the defrost-mode expansion valve 142 outputs refrigerant at a pressure of about (e.g., within about 5% of) 841 psig. In such embodiments, the evaporator 130 is rated for pressures of at least 870 psig. In some embodiments, the defrost-mode expansion valve 142 outputs refrigerant at a pressure of about (e.g., within about 5% of) 624 psig. In such embodiments, the evaporator 130 is rated for pressures of at least 650 psig.

Once defrost mode operation is complete, the controller 170 may end defrost mode operation by closing defrost-mode expansion valve 142, closing first valve 126, and opening second valve 132 to return to the refrigeration mode configuration illustrated in FIG. 1. In some embodiments, the controller 170 may cause defrost mode to end after a predefined period of time included in the instructions 178. In some embodiments, the controller 170 may cause defrost to mode to end after predefined conditions indicated in the instructions 178 are measured by the temperature and/or pressure sensor 158.

Refrigerant from the LT evaporator units 124*a,b* that are operating in refrigeration mode (i.e., LT evaporator units 124*a* and 124*b* in FIG. 1 and LT evaporator unit 124*b* in FIG. 2) is provided to the one or more LT compressors 134. The LT compressor(s) 134 are configured to compress refrigerant discharged from the LT evaporator units 124*a* and/or 124*b*. The compressed refrigerant from the LT compressors 134 is provided to the MT compressors 120 for supplemental compression. A pressure-relief valve 136 may be located on the discharge side of the LT compressors 134 and configured to open to decrease pressure if the pressure is greater than a threshold value (e.g., of about 585 psig). Refrigeration system 100 may include any suitable number of LT compressors 134. LT compressor(s) 134 may vary by design and/or by capacity. For example, some compressor designs may be more energy efficient than other compressor designs, and some LT compressors 134 may have modular capacity (e.g., a capability to vary capacity). The controller 170 may be in communication with the LT compressors 134 and controls their operation.

Flash gas bypass valve 138 may be located in refrigerant conduit connecting the flash tank 108 to the MT compressors 120 and configured to open and close to permit or restrict the flow of flash gas discharged from flash tank 108. In some embodiments, controller 170 controls the opening and closing of flash gas bypass valve 138. As depicted in FIGS. 1 and 2, closing flash gas bypass valve 138 may restrict flash gas from flowing to MT compressors 120 and opening flash gas bypass valve 138 may permit flow of flash gas to MT compressors 120.

The oil separator 122 may be located downstream the MT compressors 120. The oil separator 122 is operable to separate compressor oil from the refrigerant. The refrigerant is provided to the gas cooler 104, while the oil may be collected and returned to the MT compressors 120, as appropriate.

The defrost-mode expansion valve 142 is located downstream from the oil separator 122 and in fluid communication with the MT evaporator units 110*a,b* and LT evaporator units 124*a,b* via fluid conduits 146*a-d*. In the example of FIGS. 1 and 2, the defrost-mode expansion valve 142 is connected to the outlet of oil separator 122 via conduit 152 and to the refrigerant conduits 146*a-d* via conduit 154. In some cases defrost-mode expansion valve 142 may connected upstream of the oil separator 122 (or the oil separator 122 may not be present), such that output from the MT compressors 120 is received by the defrost-mode expansion valve 142. In some embodiments, a dedicated MT compressor 120 (e.g., one of the multiple MT compressors 120 illustrated in FIGS. 1 and 2) is configured to turn on and provide compressed refrigerant to the defrost-mode expansion valve 142 when operation of at least one of the evaporator units 110*a,b*, 124*a,b* is indicated. The defrost-mode expansion valve 142 is configured, when opened, to allow refrigerant discharged from at least one of the MT compressors 120 to flow to the evaporators 116, 130 that are to be defrosted. The defrost-mode expansion valve 142 may be similar to or the same as expansion valve 114 or 128, described in greater detail above. The controller 170 is in communication with defrost-mode expansion valve 142 and controls its operation, for example, by causing it to open for operating at least one evaporator unit 110*a,b*, 124*a,b* in defrost mode, as illustrated in FIG. 2, and to close when all of the evaporator units 110*a,b*, 124*a,b* are operated in refrigeration mode, as illustrated in FIG. 1.

In some embodiments, each of the refrigerant conduits 146*a-d* includes a corresponding controllable valve 148*a-d* to adjust the flow of refrigerant through the corresponding conduit 146*a-d*. This may facilitate control of the distribution of refrigerant to two or more evaporator units 110*a,b*, 124*a,b* that are operated in defrost mode at the same time. Valves 148*a-d* may be in communication with and controlled by controller 170. An optional pressure-relief valve 150 may be in line with refrigerant conduits 146*a-d*, as illustrated in FIGS. 1 and 2. The pressure-relief valve 150 may open if a pressure of the refrigerant provided by the defrost-mode expansion valve 142 exceeds a threshold value (e.g., of greater than the 45 bar or 60 bar limits of the evaporators 116, 130). In some embodiments, a pressure-relief valve 150 is not needed and is not present in the refrigeration system 100.

A temperature and/or pressure sensor 144 may be located downstream of the defrost-mode expansion valve 142. The temperature and/or pressure sensor 144 measures properties of the refrigerant that is to be provided to defrost evaporators 116, 130. The controller 170 is in communication with the temperature and/or pressure sensor 144 and may use the measured property(ies) to adjust the defrost-mode expansion valve 142. For example, if refrigerant pressure downstream from the defrost-mode expansion valve 142 is greater than a threshold value (e.g., indicated by the controller's instructions 178), the controller 170 may cause the defrost-mode expansion valve 142 to be adjusted, such that the refrigerant pressure is decreased.

As described above, controller 170 is in communication with at least the defrost-mode expansion valve 142, valves 112, 118 of the MT evaporator units 110*a,b*, and valves 126, 132 of the LT evaporator units 124*a,b*. The controller 170 adjusts operation of components of the refrigeration system 100 to operate the evaporator units 110*a,b*, 124*a,b* in refrigeration mode or defrost mode as appropriate. The controller includes a processor 172, memory 174, and input/output (I/O) interface 176. The processor 172 includes one or more processors operably coupled to the memory 174. The processor 172 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 174 and controls the operation of refrigeration system 100.

The processor 172 may be a programmable logic device, a microcontroller, a microprocessor, or any suitable combination of the preceding. The processor 172 is communicatively coupled to and in signal communication with the memory 174. The one or more processors are configured to process data and may be implemented in hardware or software. For example, the processor 172 may be 8-bit, 16-bit, 32-bit, 64-bit or of any other suitable architecture. The processor 172 may include an arithmetic logic unit (ALU) for performing arithmetic and logic operations, processor registers that supply operands to the ALU and store the results of ALU operations, and a control unit that fetches instructions from memory 174 and executes them by directing the coordinated operations of the ALU, registers, and other components. The processor 172 may include other hardware and software that operates to process information, control the refrigeration system 100, and perform any of the functions described herein (e.g., with respect to FIGS. 1-4). The processor 172 is not limited to a single processing device and may encompass multiple processing devices. Similarly, the controller 170 is not limited to a single controller but may encompass multiple controllers.

The memory 174 includes one or more disks, tape drives, or solid-state drives, and may be used as an over-flow data storage device, to store programs when such programs are selected for execution, and to store instructions and data that are read during program execution. The memory 174 may be volatile or non-volatile and may include ROM, RAM, ternary content-addressable memory (TCAM), dynamic random-access memory (DRAM), and static random-access memory (SRAM). The memory 174 is operable (e.g., or configured) to store information used by the controller 170 and/or any other logic and/or instructions for performing the function described in this disclosure. For example, the memory 174 may store instructions 178 for performing the functions of the controller 170 described in this disclosure. The instructions 178 may include, for example, a schedule for performing defrost mode operations, threshold temperature and/or pressure levels for determining when defrost is complete (e.g., based on information from sensors 156, 158 or other sensors of the refrigeration system 100), and the like.

The I/O interface 176 is configured to communicate data and signals with other devices. For example, the I/O interface 176 may be configured to communicate electrical signals with components of the refrigeration system 100 including the compressors 120, 134, gas cooler 104, valves 106, 112, 114, 118, 126, 128, 132, 138, 140, 142, 148*a-d*, evaporators 116, 130, and sensors 156, 158. The I/O interface 176 may be configured to communicate with other devices and systems. The I/O interface 176 may provide and/or receive, for example, compressor speed signals, compressor on/off signals, temperature signals, pressure signals, temperature setpoints, environmental conditions, and an operating mode status for the refrigeration system 100 and send electrical signals to the components of the refrigeration system 100. The I/O interface 176 may include ports or terminals for establishing signal communications between the controller 170 and other devices. The I/O interface 176 may be configured to enable wired and/or wireless communications.

Although this disclosure describes and depicts refrigeration system 100 including certain components, this disclosure recognizes that refrigeration system 100 may include any suitable components. As an example, refrigeration system 100 may include one or more additionally sensors configured to detect temperature and/or pressure information. In some embodiments, each of the compressors 120, 134, gas cooler 104, flash tank 108, and evaporators 116, 130 include one or more sensors.

In an example operation of the refrigeration system 100, the refrigeration system 100 is initially operating with all evaporator units 110*a,b*, 124*a,b* in the refrigeration mode, as illustrated in FIG. 1. In this mode, the defrost-mode expansion valve 142 is closed. All of the MT evaporator units 110*a,b* are configured as shown for MT evaporator 110*a* in FIG. 1 (i.e., with first valve 112 closed and second valve 118 open), and all of the LT evaporator units 124*a,b* are configured as shown for LT evaporator 124*a* in FIG. 1 (i.e., with first valve 126 closed and second valve 132 open).

At some point during operation of the refrigeration system 100, the controller 170 determines that defrost mode operation is needed for the first MT evaporator unit 110*a* and the first LT evaporator unit 124*a*. For example, the first MT evaporator unit 110*a* and the first LT evaporator unit 124*a* may be scheduled for defrost at the same time that has just been reached. After determining that the defrost mode operation is indicated, the controller 170 causes the first MT evaporator 110*a* and the first LT evaporator 124*a* to be configured according to FIG. 2. In other words, the controller 170 causes first valves 112, 126 to open and second valves 118, 132 to close. The controller 170 also causes the defrost-mode expansion valve 142 to at least partially open. The controller 170 may cause the defrost-mode expansion valve 142 to open to achieve desired properties of the refrigerant downstream from the defrost-mode expansion valve 142. For example, temperature and/or pressure measured by sensor 144 (described above) may be used to adjust expansion valve 142 to achieve a predefined refrigerant temperature and/or pressure, which may be indicated in the controller's instructions 178.

With the defrost-mode expansion valve 142 at least partially open and the evaporator units 110*a* and 124*a* configured as shown in FIG. 2, a portion of refrigerant that was compressed by MT compressors 120 is provided to the evaporator units 110*a*, 124*a*, as illustrated in FIG. 2. For example, compressed heated refrigerant is provided via refrigerant conduit 146*a* to the evaporator 130 and via refrigerant conduit 146*b* to the evaporator 116. The heated refrigerant is allowed to flow through the evaporators 116, 130 to defrost the evaporators 116, 130. Defrost operation may proceed for a predefined period of time. After this period of time, the evaporator units 110*a*, 124*a* may be returned to operating in refrigeration mode, as shown in FIG. 1. In other words, the controller 170 causes first valves 112, 126 to close and second valves 118, 132 to open. The controller 170 may also cause the defrost-mode expansion valve 142 to close if defrost mode operation is not ongoing in any other evaporator unit 110*b*, 124*b*.

Figure 3:
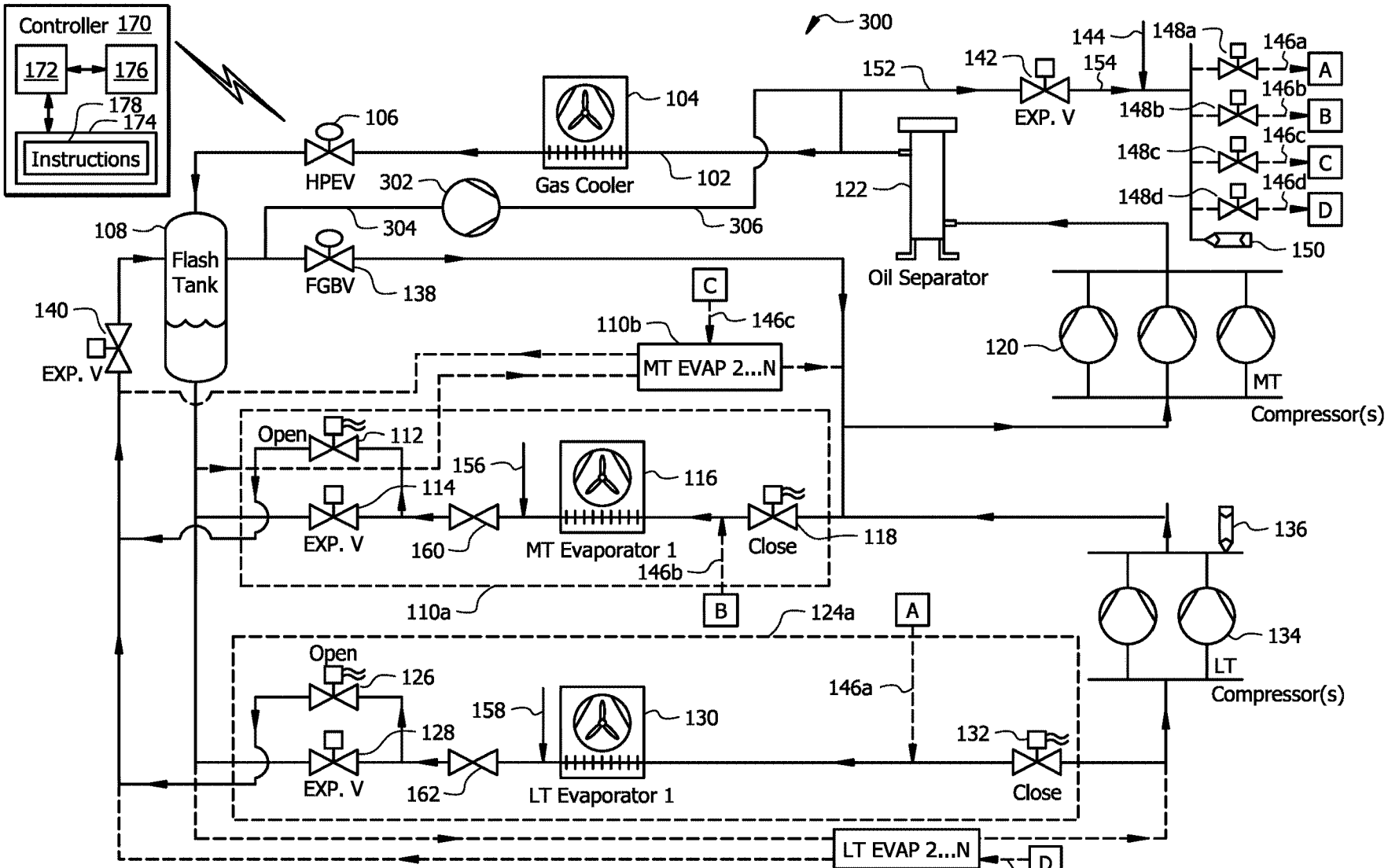
FIG. 3 is a diagram of a refrigeration system similar to that of FIG. 1 with an additional defrost refrigerant line when the system is configured to operate a low temperature and medium temperature evaporator unit in defrost mode.

FIG. 3 illustrates a modified refrigeration system 300 which includes all elements of refrigeration system 100, described above, along with a supplemental compressor 302. The compressor 302 is connected to the flash tank 108 via refrigerant conduit 304 and to the defrost-mode expansion valve 142 via refrigerant conduit 306. The compressor 302 may be the same as or similar to the MT compressors 120 described with respect to FIGS. 1 and 2 above. The controller 170 is in communication with the compressor 302 and controls its operation. In some embodiments, the controller 170 causes the compressor 302 to turn on when at least one of the evaporator units 110*a,b*, 124*a,b* is operating in defrost mode, as illustrated in FIG. 3. The compressor 302 may compress flash gas from flash tank 108 to the same output pressure of the MT compressors 120. The compressed flash gas is provided along with the refrigerant that was heated and compressed by MT compressors 120 to the defrost-mode expansion valve 142.

Example Method of Operation

Figure 4:
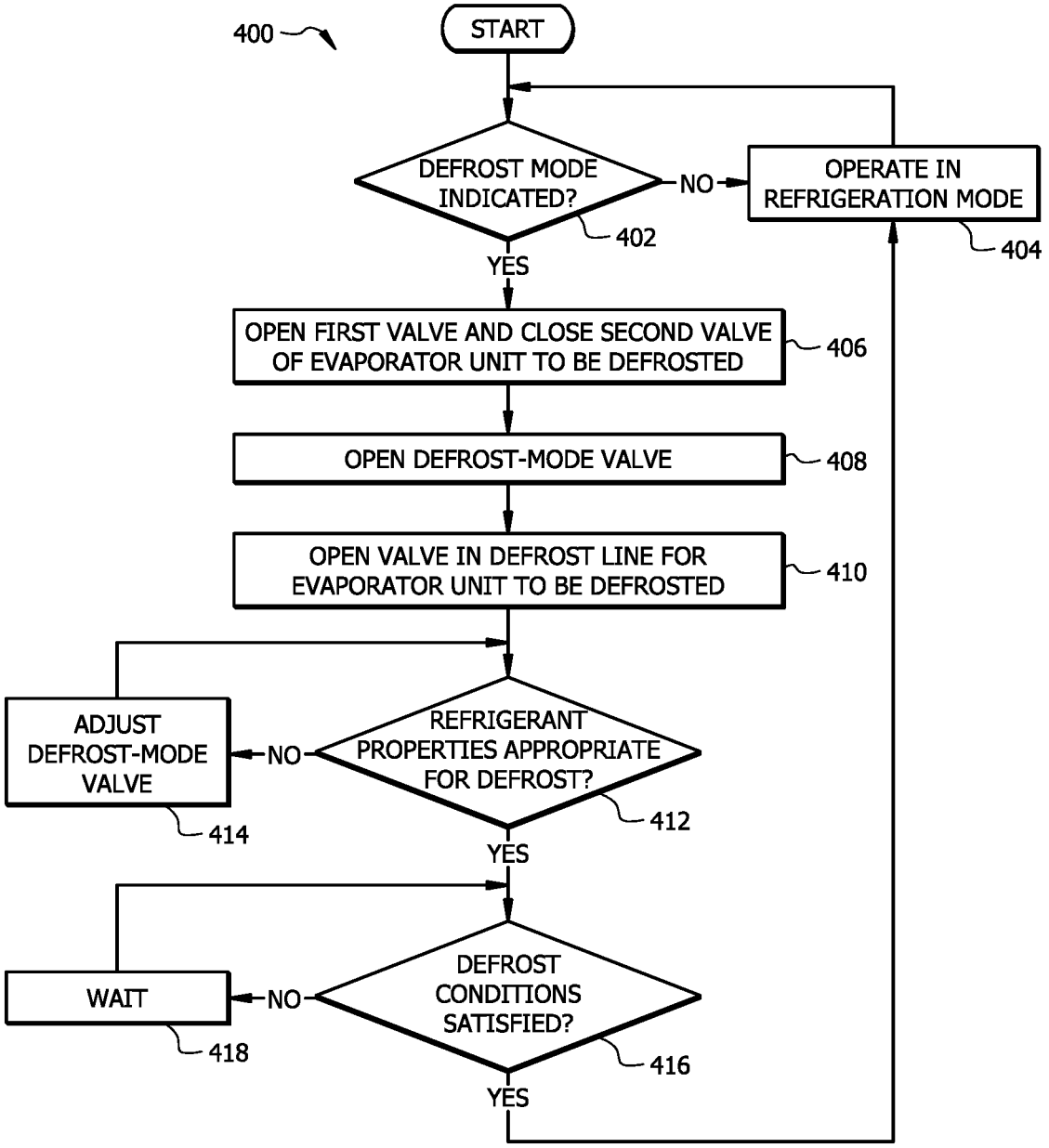
FIG. 4 is a flowchart of an example method of operating the refrigeration system of FIGS. 1-3 to provide improved evaporator defrost.

FIG. 4 illustrates a method 400 of operating the refrigeration systems 100, 300 described above with respect to FIGS. 1, 2, and 3. The method 400 may be implemented using the processor 172, memory 174, and I/O interface 176 of the controller 170 of FIGS. 1 and 2. The method 400 may begin at step 402 where the controller 170 determines whether defrost mode is indicated for any of the evaporator units 110*a,b*, 124*a,b*. For example, the controller 170 may determine whether the instructions 178 indicate that a defrost cycle is scheduled for one of the evaporator units 110*a,b*, 124*a,b*. As another example, the controller 170 may determine whether a temperature measured at an evaporator 116, 130 indicates decreased performance (e.g., if a target temperature is not being reached). This behavior may indicate that defrost mode operation is indicated. If defrost mode is not indicated, the controller 170 proceeds to step 404 and operates the evaporator units 110*a,b*, 124*a,b* in the refrigeration mode. If defrost mode operation is indicated, the controller 170 may proceed to step 406.

At step 406, the controller 170 causes the first valve 112, 126 to open and the second valve 118, 132 to close in the evaporator unit 110*a,b*, 124*a,b* for which defrost mode operation was indicated at step 402. This achieves the defrost mode configuration illustrated in FIG. 2. In the refrigeration system 300 of FIG. 3, the controller 170 may also turn on compressor 302 to provide compressed flash gas to the defrost-mode expansion valve 142.

At step 408, the controller 170 at least partially opens the defrost-mode expansion valve 142. After being opened, the defrost-mode expansion valve 142 allows heated refrigerant output by the MT compressor(s) 120 (or from oil separator 122) to be provided to the evaporator unit 110*a,b*, 124*a,b* for which defrost operation was indicated at step 402. In some cases (e.g., where defrost mode operation is indicated for multiple evaporator units 10*a,b*, 124*a,b*), the controller 170, at step 410, may adjust valves 148*a-d* to control flow of heated refrigerant to the evaporator units 110*a,b*, 124*a,b* for which defrost mode operation was indicated at step 402. This may facilitate improved control over the defrost process (e.g., if a greater flow rate of refrigerant is needed for one evaporator type than another).

At step 412, the controller 170 may determine whether the properties of the refrigerant received from defrost-mode expansion valve 142 are appropriate for defrosting the evaporator 116, 130 for which defrost mode was indicated at step 402. For example, controller 170 may use a temperature and/or pressure measured by sensor 144 to determine if the refrigerant provided from defrost-mode expansion valve 142 can be received by the evaporator(s) 116, 130 without damaging the evaporator(s) 116, 130. For instance, if a refrigerant pressure measured by sensor 144 exceeds a pressure rating of the evaporator(s) 116, 130 being defrosted, then the refrigerant properties are not appropriate for defrosting the evaporator(s) 116, 130.

If the refrigerant properties are not appropriate for defrost at step 412, the controller 170 may proceed to step 414 where the defrost-mode expansion valve 142 is adjusted to bring the refrigerant properties into line with what is needed for effective defrost. For example, the defrost-mode expansion valve 142 may be adjusted to achieve a pressure that is within the specifications of the evaporator(s) 116, 130 being defrosted. Once the appropriate conditions are satisfied at step 412, the controller 170 proceeds to step 416.

At step 416, the controller 170 determines whether defrost conditions are satisfied for ending defrost mode operation. The defrost conditions may be indicated by the instructions 178 stored in the memory 174 of the controller 170. For example, the defrost conditions may indicate that defrost mode operation must be performed for a predefined period of time. As another example, the defrost conditions may indicate that an output temperature at or near the positions of sensor 156, 158 must increase to at least a predefined temperature (e.g., of about 11° C.) before defrost mode operation is complete. If the defrost conditions are not met, the controller 170 proceeds to step 418 to wait a period of time before returning to step 412.

If the defrost conditions of step 416 are satisfied, the controller 170 proceeds to step 404 and returns to operating in the refrigeration mode. In order to operate in the refrigeration mode at step 404, the controller 170 may cause the first valve 112, 126 to close and the second valve 118, 132 to open. If no other evaporator unit 110*a,b*, 124*a,b* is operating in the defrost mode, the defrost-mode expansion valve 142 may be closed.

Modifications, additions, or omissions may be made to method 400 depicted in FIG. 4. Method 400 may include more, fewer, or other steps. For example, steps may be performed in parallel or in any suitable order. While at times discussed as controller 170, refrigeration system 100, or components thereof performing the steps, any suitable refrigeration system or components of the refrigeration system may perform one or more steps of the method 400.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A refrigeration system comprising one or more compressors, a gas cooler located downstream from the one or more compressors, a defrost-mode expansion valve located downstream from the one or more compressors, at least one first evaporator unit located downstream from the gas cooler, and a controller communicatively coupled to the defrost-mode expansion valve, a first valve, and a second valve, wherein:

the one or more compressors are configured to compress a refrigerant;

the gas cooler is configured to receive at least a portion of the compressed refrigerant as a received refrigerant and facilitate heat transfer from the received refrigerant, thereby cooling the refrigerant;

the at least one first evaporator unit comprises an evaporator, an expansion valve located upstream of the evaporator when the at least one first evaporator unit is operated in a refrigeration mode, the first valve located upstream of the evaporator when operated in the refrigeration mode, the second valve located downstream of the evaporator when operated in the refrigeration mode, wherein the first valve is closed and the second valve is open when operated in the refrigeration mode, and wherein the expansion valve is configured to receive a portion of the refrigerant cooled by the gas cooler and the evaporator is configured to receive the refrigerant from the expansion valve when the at least one first evaporator unit is operated in the refrigeration mode;

the refrigeration system further comprises a pressure-relief valve disposed between the at least one first evaporator unit and the defrost-mode expansion valve, the pressure-relief valve configured to open when a pressure of an expanded portion of the refrigerant from the defrost-mode expansion valve is greater than a threshold value after passing through the defrost-mode expansion valve, and a sensor disposed adjacent a downstream side of the defrost-mode expansion valve, the sensor configured to provide at least one of temperature and pressure information of the compressed refrigerant to the controller;

the controller is configured to:

determine that operation of the at least one first evaporator unit in a defrost mode is indicated; and after determining that operation of the at least one first evaporator unit in the defrost mode is indicated, cause the at least one first evaporator unit to operate in the defrost mode, wherein causing the at least one first evaporator unit to operate in the defrost mode comprises causing the defrost-mode expansion valve to at least partially open based on at least one of the temperature and pressure information from the sensor to adjust a flow of compressed refrigerant; and the defrost-mode expansion valve is configured, when open, to divert a portion of the compressed refrigerant provided by the one or more compressors away from the gas cooler, expand the diverted portion of the refrigerant, and allow the expanded portion of the refrigerant to flow to the least one first evaporator unit, thereby defrosting the evaporator of the at least one first evaporator unit; and the controller is further configured to cause the at least one first evaporator unit to operate in the defrost mode by causing the first valve to open and by causing the second valve to close, wherein the diverted portion of the refrigerant exiting the evaporator flows through the first valve when operating in the defrost mode.

2. The refrigeration system of claim 1, further comprising:

a flash tank configured to store refrigerant cooled by the gas cooler; and a refrigerant conduit configured to allow a flow of a portion of the refrigerant stored in the flash tank to the defrost-mode expansion valve.

3. The refrigeration system of claim 2, further comprising:

a supplemental compressor located in the refrigerant conduit upstream from the defrost-mode expansion valve, wherein the controller is communicatively coupled to the supplemental compressor and configured to cause the supplemental compressor to turn on when causing the at least one first evaporator unit to operate in the defrost mode.

4. The refrigeration system of claim 2, further comprising a at least one second evaporator unit located downstream from the flash tank, wherein, while the at least one first evaporator unit is caused to operate in the defrost mode, the at least one second evaporator unit is caused to operate in the refrigeration mode.

5. The refrigeration system of claim 1, further comprising an oil separator positioned and configured to remove oil from the compressed refrigerant before the compressed refrigerant is provided to the gas cooler and the defrost-mode expansion valve.

6. The refrigeration system of claim 1, wherein the controller is further configured to cause the defrost-mode expansion valve to close after causing the first evaporator unit to operate in the defrost mode for a predefined period of time.

7. The refrigeration system of claim 1, wherein the controller is further configured to cause the defrost-mode expansion valve to close after a temperature of refrigerant exiting the evaporator of the at least one first evaporator unit is greater than or equal to a threshold value.

8. A method of operating a refrigeration system, the method comprising:

determining that operation of at least one first evaporator unit of the refrigeration system in a defrost mode is indicated, wherein the at least one first evaporator unit comprises an evaporator, an expansion valve located upstream of the evaporator when the at least one first evaporator unit is operated in a refrigeration mode, a first valve located upstream of the evaporator when operated in the refrigeration mode, a second valve located downstream of the evaporator when operated in the refrigeration mode, wherein the first valve is closed and the second valve is open when operated in the refrigeration mode, and wherein the expansion valve is configured to receive a portion of the refrigerant cooled by a gas cooler and the evaporator is configured to receive the refrigerant from the expansion valve when the at least one first evaporator unit is operated in the refrigeration mode, the refrigeration system including a pressure-relief valve disposed between the at least one first evaporator unit and a defrost-mode expansion valve, the pressure-relief valve configured to open when a pressure of an expanded portion of the refrigerant from the defrost-mode expansion valve is greater than a threshold value after passing through a defrost-mode expansion valve, and a sensor disposed adjacent a downstream side of the defrost-mode expansion valve, the sensor configured to provide at least one of temperature and pressure information of a compressed refrigerant;

after determining that operation of the at least one first evaporator unit in the defrost mode is indicated, causing the at least one first evaporator unit to operate in the defrost mode by:

causing the first valve of the at least one first evaporator unit to open;

causing the second valve of the at least one first evaporator unit to close; and causing the defrost-mode expansion valve of the refrigeration system to at least partially open based on at least one of the temperature and pressure information from the sensor to adjust a flow of the compressed refrigerant, wherein the defrost-mode expansion valve is located between one or more compressors and the gas cooler of the refrigeration system, such that a portion of the compressed refrigerant provided from one or more compressors of the refrigeration system is diverted away from the gas cooler, expanded, and provided to the evaporator of the at least one evaporator unit as a diverted portion of the refrigerant, thereby defrosting the evaporator, and wherein the diverted portion of the refrigerant exiting the evaporator flows through the first valve when operating in the defrost mode.

9. The method of claim 8, wherein further comprising causing a supplemental compressor to turn on, such that compressed flash gas from a flash tank of the refrigeration system is provided to the defrost-mode expansion valve.

10. The method of claim 8, further comprising, while causing with the at least one first evaporator unit to operate in the defrost mode, causing at least one second evaporator unit to operate in a refrigeration mode.

11. The method of claim 8, further comprising causing the defrost-mode expansion valve to close after causing with the at least one first evaporator unit to operate in the defrost mode for a predefined period of time.

12. The method of claim 8, further comprising causing the defrost-mode expansion valve to close after a temperature of refrigerant exiting the evaporator of with the at least one first evaporator unit is greater than or equal to a threshold value.

13. A refrigeration system comprising one or more compressors, a gas cooler located downstream from the one or more compressors, a defrost-mode expansion valve located downstream from the one or more compressors, and at least one first evaporator unit located downstream from the gas cooler, wherein:

the one or more compressors are configured to compress a refrigerant;

the gas cooler is configured to receive at least a portion of the compressed refrigerant as a received refrigerant and facilitate heat transfer from the received refrigerant, thereby cooling the refrigerant;

the at least one first evaporator unit comprises an evaporator, an expansion valve located upstream of the evaporator when the at least one first evaporator unit is operated in a refrigeration mode, a first valve located upstream of the evaporator when operated in the refrigeration mode, a second valve located downstream of the evaporator when operated in the refrigeration mode, wherein the first valve is closed and the second valve is open when operated in the refrigeration mode, and wherein the expansion valve is configured to receive a portion of the refrigerant cooled by the gas cooler and the evaporator is configured to receive the refrigerant from the expansion valve when the at least one first evaporator unit is operated in the refrigeration mode;

the refrigeration system further comprises a pressure-relief valve disposed between the at least one first evaporator unit and the defrost-mode expansion valve, the pressure-relief valve configured to open when a pressure of an expanded portion of the refrigerant from the defrost-mode expansion valve is greater than a threshold value after passing through the defrost-mode expansion valve, and a sensor disposed adjacent a downstream side of the defrost-mode expansion valve, the sensor configured to provide at least one of temperature and pressure information of the compressed refrigerant to a controller; and the defrost-mode expansion valve is configured to at least partially open based on at least one of the temperature and pressure information from the sensor to adjust a flow of the compressed refrigerant, when at least partially open for operating the at least one first evaporator unit in a defrost mode, divert a portion of the compressed refrigerant provided by the one or more compressors away from the gas cooler, expand the diverted portion of the refrigerant, and allow the expanded portion of the refrigerant to flow to the at least one first evaporator unit, thereby defrosting an evaporator of the at least one first evaporator unit, wherein the first valve is open and the second valve is closed when the at least one first evaporator unit is operating in the defrost mode, and wherein the diverted portion of the refrigerant exiting the evaporator flows through the first valve when operating in the defrost mode.

14. The refrigeration system of claim 13, further comprising:

a flash tank configured to store refrigerant cooled by the gas cooler; and a refrigerant conduit configured to allow a flow of a portion of the refrigerant stored in the flash tank to the defrost-mode expansion valve.

15. The refrigeration system of claim 14, further comprising:

a supplemental compressor located in the refrigerant conduit upstream from the defrost-mode expansion valve and configured to turn on when the at least one first evaporator unit is operated in the defrost mode.

16. The refrigeration system of claim 13, wherein the defrost-mode expansion valve is configured to close after the at least one first evaporator unit is operated in the defrost mode for a predefined period of time.

* * * * *